United States Patent [19]

Kurland et al.

[11] 4,318,970

[45] Mar. 9, 1982

[54] PROCESS FOR FABRICATING PHOTOSENSITIVE LAYERS ON PLASTIC SUBSTRATES

[75] Inventors: Irwin J. Kurland, North Hollywood; Andrejs Graube, Marina Del Rey, both of Calif.

[73] Assignee: Hughes Aircraft Company, Culver City, Calif.

[21] Appl. No.: 137,343

[22] Filed: Apr. 4, 1980

[51] Int. Cl.[3] ..... G03C 5/04

[52] U.S. Cl. ..... 430/2; 430/1; 430/523; 430/945; 430/954

[58] Field of Search ..... 430/1, 2, 954, 523, 430/945

[56] References Cited

U.S. PATENT DOCUMENTS

| | | | |
|---|---|---|---|
| 3,637,416 | 1/1972 | Misch et al. | 351/160 |
| 3,645,779 | 2/1972 | Kienel | 351/166 |
| 3,811,753 | 5/1974 | Onoki et al. | 350/178 |
| 3,864,132 | 2/1975 | Rasch et al. | 430/954 |
| 3,928,108 | 12/1975 | Adicoff et al. | 156/246 |
| 3,984,581 | 10/1976 | Dobler et al. | 427/35 |
| 4,032,338 | 6/1977 | Gange | 346/151 |
| 4,076,772 | 2/1978 | Murbach et al. | 430/2 |

OTHER PUBLICATIONS

Duffin, Photographic Emulsion Chemistry, pp. 51–54, Focal Press, London, 1966.

McCauley et al., Applied Optics, vol. 12, pp. 232–242, 1973.

*Primary Examiner*—J. Travis Brown

*Attorney, Agent, or Firm*—David W. Collins; W. H. MacAllister

[57] ABSTRACT

An improved process is provided for attaching layers of hydrophilic, photosensitive materials onto hydrophobic plastic substrates, which comprises forming a layer of a glassy, optically transparent, polar, moisture barrier material on the substrate prior to depositing the photosensitive layer thereon. The process is especially suitable for the fabrication of pre-holographic elements and holograms.

23 Claims, 3 Drawing Figures

PROCESS FOR FABRICATING PHOTOSENSITIVE LAYERS ON PLASTIC SUBSTRATES

BACKGROUND OF THE INVENTION

1. Field of the Invention

The invention relates to a process for attaching layers of hydrophilic, photosensitive materials onto hydrophobic plastic substrates, and, in particular, to a process for forming pre-holographic elements and holograms comprising hydrophilic photosensitive materials on hydrophobic plastic substrates.

2. Description of the Prior Art

It has been widely recognized in the photographic art that a light-sensitive photographic emulsion, or photosensitive material, applied directly to the surface of a plastic support or substrate does not exhibit sufficient adhesion to the support film for use in most of the usual photographic end uses. As a result, it has become common practice to interpose one or more "subbing" layers between the support film and the photographic emulsion or photosensitive material. These problems also obtain for holographic applications, since photosensitive materials applied to plastic substrates are also employed.

There are many problems attending the use of chemical subbing layers on photographic and holographic plastic substrates. In addition to the obvious drawbacks of having to deposit one or more subbing layers, these subbing layers:

(1) are specific to plastics of different chemical composition;

(2) do not prevent the diffusion of water vapor into the photosensitive layer and therefore do not improve hologram stability; and (3) can be grainy and non-uniform in thickness, which graininess causes light scattering noise during exposure and which non-uniformity causes phase errors in transmitted light.

Chemical subbing techniques for photographic plastic substrates are the subject of a review in a book by G. F. Duffin, *Photographic Emulsion Chemistry*, Focal Press Limited, London, 1966. A technique for chemically subbing poly-(methyl methacrylate) for use as a dichromated gelatin holographic substrate is the subject of an article by D. G. McCauley et al, in Vol. 12, Applied Optics, pp. 232–242 (1973).

While the subbing layers of the prior art are generally suitable for regular photographic substrates, the graininess and non-uniformity limits their usefulness for fabricating holograhic substrates.

SUMMARY OF THE INVENTION

In accordance with the invention, processes for fabricating pre-holographic elements supported on hydrophobic substrates and holograms are provided. A pre-holographic element supported on a hydrophobic substrate is fabricated by a process which comprises:

(a) forming a layer of a glassy, optically transparent, polar, moisture barrier material on at least a portion of the hydrophobic substrate by a process which generates a temperature at the substrate less than that of its softening point at which it deforms; and (b) forming a layer of a hydrophilic, photosensitive material on at least a portion of the moisture barrier layer.

A hologram is fabricated by a process which comprises:

(a) exposing the photosensitive layer of the preholographic element to an actinic interference pattern to record a latent image thereon;

(b) developing the photosensitive layer to obtain the recorded latent image; and (c) forming a protective layer on the photosensitive layer.

The manner in which the glassy moisture barrier layer is formed on the substrate gives the moisture barrier layer good adherence to the hydrophobic plastic, while the polar properties of the moisture barrier layer make it readily adhere to the hydrophilic photosensitive layer. The monolayer subbing technique of the invention for plastic substrates is applicable to plastic substrates of different compositions, yields good photosensitive film adhesion while eliminating light scattering noise and phase errors and reduces water vapor diffusion into the photosensitive layer, thereby improving hologram lifetime.

DETAILED DESCRIPTION OF THE INVENTION

Holograms are finding a variety of uses, including helmet-mounted displays such as disclosed in U.S. Pat. No. 3,928,108, eye protection reflectors for laser radiation and novelty displays, such as pendant jewelry. In fabricating a hologram, a pre-holographic element comprising a photosensitive layer on a substrate is processed to expose the photosensitive layer to an actinic interference pattern to record a latent image thereon. The photosensitive layer is then developed to obtain the recorded latent image and the photosensitive layer is covered with a protective layer. By actinic radiation is meant that radiation which has an effect on the photosensitive layer.

The pre-holographic element is fabricated by a process which comprises:

(a) forming a layer of a glassy, optically transparent, polar, moisture barrier material on at least a portion of a hydrophobic substrate by a process which generates a temperature at the substrate less than that of its softening point at which it deforms; and (b) forming a layer of a hydrophilic, photo-sensitive material on at least a portion of the moisture barrier layer.

As used herein, hydrophilic photosensitive layers include photographic and holographic emulsions which utilize hydrophilic organic colloids as an emulsion vehicle. Hydrophobic plastic substrates include materials such as cellulose-acetate, polystyrene, polyester, poly-(methyl methacrylate) and polycarbonate.

Figure 1:
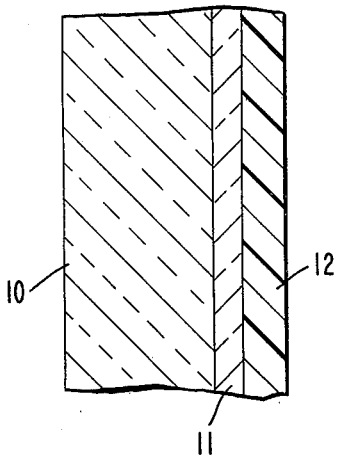
FIG. 1, in cross-section, depicts a pre-holographic element of the invention.

As shown in FIG. 1 (not to scale), which depicts a cross-sectional view of a pre-holographic element, hydrophobic substrate 10 supports moisture barrier layer 11 which in turn supports photosensitive material 12. The coated substrate may be of any shape, such as planar, as shown in FIG. 1, spherical, cylindrical, aspherical and combinations thereof.

The hydrophobic substrate may comprise any of the optically transparent plastic materials suitable in the art and include materials such as celluoseacetate, polystyrene, polyester, poly-(methyl methacrylate) and polycarbonate and copolymers containing these polymers.

The thickness of the substrate is not critical, other than that it be thick enough to provide adequate support, that is, be mechanically rigid or stable to support the photosensitive layer, and thin enough to be substantially optically transmissive, as described below. Typical thicknesses range from about 1/10 to ¼ inch.

By optically transparent, as used herein, is meant that the material is substantially transparent at least over the visible and near-infrared regions. For all optically transparent layers combined, the radiation transmitted to the photosensitive layer should be at least about 95% of the radiation incident on the surface of the outermost layer.

The moisture barrier material between the hydrophobic substrate and hydrophilic photosensitive layer comprises a glassy, optically transparent, polar material. The barrier material is glassy in nature, being an inorganic substance that has cooled to a rigid condition without crystallizing. The polarity of the moisture barrier layer should be adequate to provide sufficient adhesion of the photosensitive layer thereto. Since the polar character of the photosensitive layer varies from one material to another, consideration must be given to the particular moisture barrier material selected so as to ensure good adherence. In any event, simple expermentation is sufficient in selecting suitable materials. The moisture barrier layer provides a barrier against diffusion of water vapor such that over the lifetime of the device (typically about 3 to 5 years), no more than about $2\times10^{-6}$ g $H_2O/cm^2$ is transmitted. Examples of such materials include glasses having a high coefficient of expansion of about $10^{-5}$/°C. Exemplary glasses are silicate, alkali silicate, soda-lime, borosilicate and lead glasses and glasses containing these glasses as primary constituent.

The thickness of the moisture barrier layer is not per se critical, other than that it be thick enough to provide the moisture barrier protection noted above and not so thick as to result in cracking due to thermal stresses resulting from different thermal coefficient of expansion of materials. For a moisture barrier layer of Corning No. 7940 glass, suitable thicknesses range from about 0.2 to 10 μm. A thickness of about 0.2 to 1 μm provides adequate moisture barrier protection consistent with minimal effects resulting from thermal stresses and is accordingly preferred.

The moisture barrier material is formed on the hydrophobic substrate by a process which generates a temperature at the substrate less than that of its softening point at which it deforms. Examples of such processes include electron beam evaporation and plasma-enhanced deposition. These well-known processes generate little heat compared with other processes, one example of which is sputtering, which tend to generate greater amounts of heat. Clearly, processes resulting in melting of the substrate would be unsuitable. However, processes which may result in temperatures sufficient to heat the substrate to its softening point, including the e-beam evaporation and plasma-enhanced deposition processes mentioned above, may be used so long as the plastic substrate is not deformed during the deposition of the moisture barrier material. Specific process parameters are readily determined by experimentation.

A layer of a hydrophilic, photosensitive material is formed on at least a portion of the moisture barrier layer by processes well-known in the art and thus such processes do not form a part of this invention; see, e.g., Vol. 12, Applied Optics, pp. 232–242 (1973) and Vol. 8, Applied Optics, pp. 2346–2348 (1969).

The hydrophilic, photosensitive layer may comprise emulsions which utilize hydrophilic organic colloids as an emulsion vehicle such as dichromated gelatin, photographic silver halide emulsion and diazo gelatin and other gelatin-based photosensitive materials. The thickness of the photosensitive layer ranges from about 1 to 100 μm, as is well-known. Generally, the thicker the layer, the more efficient in diffracting light. On the other hand, the thinner the layer, the larger the viewable angle and the larger the spectral band width. Photosensitive layers for conventional holograms typically range from about 6 to 20 μm, as is well-known.

To fabricate a hologram, the pre-holographic element is further processed by exposing the photosensitive layer, either directly or through the substrate 10, to an actinic interference pattern to record a latent image thereon. The interference pattern may be generated by a diffuse object, one or more point light sources, or other suitable sources which provide the desired coherent wavefronts employing techniques known in the art. The photosensitive layer is then developed by methods known in the art to obtain the recorded latent image. In the case of a photosensitive layer comprising dichromated gelatin, an aqueous solution, followed by dehydration with an alcohol is generally used to develop the photosensitive layer.

A protective layer is then formed on at least a portion of the developed photosensitive layer. The protective layer includes a layer of moisture barrier material, again, in order to protect the photosensitive layer against degradation effects due to the penetration of water vapor. The moisture barrier material may be any of the moisture barrier materials described above. Since the thickness of the moisture barier layer determines the rate of water vapor diffusion, advantageously, both moisture barrier layers are of substantially the same thickness.

Figure 2:
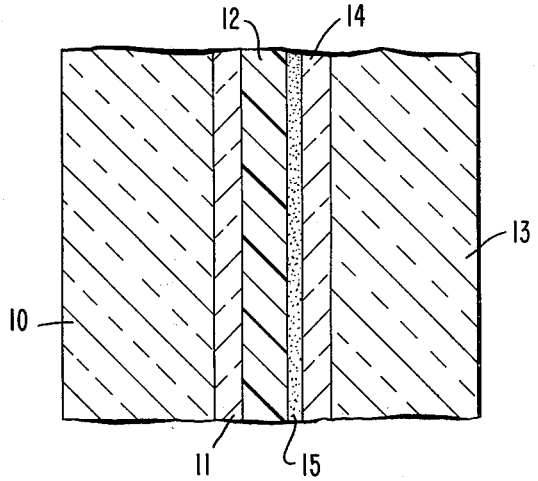
FIG. 2, in cross-section, depicts a hologram in accordance with the invention.

As shown in FIG. 2, (also not to scale) the protective layer may comprise a transparent cover material 13, such as one of the plastic substrate materials mentioned above, which is coated with a layer of the moisture barrier material 14, which is then in turn attached to the photosensitive layer by an adhesive 15 such as an optical cement. Some cements would not be suitable if moisture is released by the cement to the photosensitive layer, causing it to swell. However, simple experimentation can be used to determine the usefulness of a particular cement.

Although not shown, it is preferred that the edges of the photosensitive layer 12 also be protected. While this layer is already thin enough so that diffusion by water vapor generates minimal adverse effects, contemplated long term usage dictates such additional protection, especially in applications such as helmetmounted displays where even such minimal adverse effects are detrimental to usage.

EXAMPLES

Example 1: Comparison of Nitrocellulose Subbing with Silicon Dioxide.

Poly-(methyl methacrylate) substrates were subbed with a 0.23% solution of nitrocellulose in 2-methoxyethanol at various dilutions. The substrates were subbed in 0% R.H. (relative humidity) and 20% R.H.; no difference in fog level was observed. The following results were obtained:

| Dilution by Volume | Fog Level | Film Adhesion after 6 hr 0% R.H. |
|---|---|---|
| 1:0 | moderate | OK |
| 1:1 | some | OK |
| 1:2 | slight | OK |
| 1:4 | very light | OK |
| 1:8 | none | very minor detachment |
| 1:16 | none | some detachment |
| 1:32 | none | detached |

Clearly, the nitrocellulose subbing layer thickness is critical: as the thickness of the subbing layer is decreased by dilution of the subbing solution, fog or light scatter level decreases and film detachment increases. The best subbing layers are seen to be those prepared from dilutions ranging from 1:4 to 1:8.

In contrast, polycarbonate substrates subbed with glassy $SiO_2$ by e-beam deposition, over a thickness range of 2,000 Å to 10 μm, evidenced essentially no light scattering or light-absorption and no detachment after 6 hr in 0% R.H. atmosphere.

Example 2: Performance of Moisture Resistant Coatings.

Pre-holographic elements having the structure depicted in FIG. 1 were fabricated, employing Schott No. 8329 glass as the moisture barrier material, 0.2 μm in thickness, on a polycarbonate substrate. Dichromated gelatin, 20 μm thick, served as the photosensitive layer.

Moisture transmission rate through the protective barrier was determined by measuring the peak reflective wavelength of Lipmann grating recorded in the photosensitive dichromated gelatin layer. As water diffuses through the substrate and protective cover, it is absorbed by the dichromated gelatin film, causing it to swell. The swelling increases the separation between the Bragg planes in the Lipmann grating, causing a shift in the peak reflective wavelength that the grating diffracts. The water transmission rate can then be quantitatively determined from reflective wavelength shift measurements.

Figure 3:
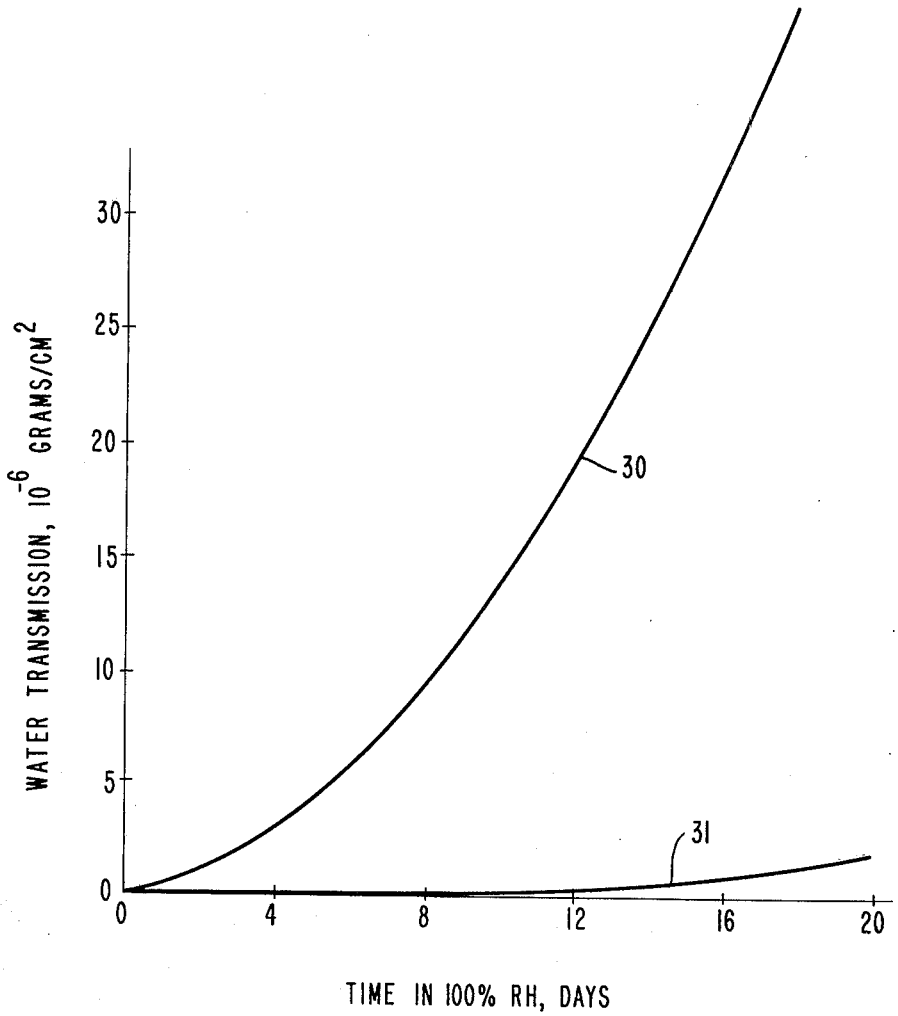
FIG. 3, on coordinates of water transmission in $g/cm^2$ and time in days, depicts the moisture resistant behavior of three substrate and cover materials.

FIG. 3, on coordinates of water transmission per unit area and time in days, depicts the moisture resistant behavior of three substrate and cover materials. Polycarbonate substrates were coated with Schott #8329 glass, deposited by electron beam. Curve 31 of FIG. 3 depicts the behavior of both solid glass and the coated polycarbonate substrates, which are virtually indistinguishable, while Curve 30 depicts the behavior of uncoated polycarbonate substitutes. As is evident from FIG. 3, the solid glass and the coated polycarbonate substrates were essentially stable, whereas the uncoated polycarbonate substrate transmitted moisture rapidly. Indeed, after about three days, sufficient moisture had penetrated the uncoated polycarbonate substrate to render the Lipmann grating unsuitable for use with a narrow wavelength band light source. The moisture in this case shifted the peak reflective wavelength sufficiently to cause a spectral mismatch between the Lipmann holographic grating and the narrow band light source.

What is claimed is:

1. A process for fabricating a preholographic element supported on an optically transparent hydrophobic substrate which comprises:

(a) forming a layer of a glassy, optically transparent, polar, moisture barrier material about 0.2 to 10 μm thick on the hydrophobic substrate by a process which generates a temperature at the substrate of less than that of its softening point at which it deforms; and (b) forming a layer of a hydrophilic, photosensitive material on at least a portion of the moisture barrier layer, the moisture barrier layer providing a barrier against diffusion of water vapor from the hydrophobic substrate into the hydrophilic, photosensitive layer such that over the lifetime of the preholographic element, no more than about $2\times10^{-6}$ g $H_2O/cm^2$ is transmitted therethrough.

2. The process of claim 1 in which the hydrophobic substrate includes a plastic material selected from the group consisting of cellulose-acetate, polystyrene, polyester, poly-(methyl methacrylate) and polycarbonate.

3. The process of claim 2 in which the plastic material is selected from the group consisting of poly-(methyl methacrylate) and polycarbonate.

4. The process of claim 1 in which the moisture barrier layer comprises a glass having a coefficient of expansion of about $10^{-5}$/°C.

5. The process of claim 4 in which the glassy moisture barrier material comprises a glass selected from the group consisting of silicate, borosilicate, alkali silicate, soda-lime and lead glasses.

6. The process of claim 5 in which the moisture barrier layer consists essentially of glassy $SiO_2$.

7. The process of claim 1 in which the thickness ranges from about 0.2 to 1 μm.

8. The process of claim 1 in which the moisture barrier layer is deposited by electron beam evaporation or plasma-enhanced deposition.

9. The process of claim 1 in which the photosensitive material is gelatin-based.

10. The process of claim 9 in which the photosensitive material comprises an emulsion selected from the group consisting of dichromated gelatin, photographic silver halide emulsion and diazo gelatin.

11. A process for fabricating a hologram on the preholographic element of claim 1 which comprises:

(a) exposing the photosensitive layer to an actinic interference pattern to record a latent image thereon;

(b) developing the photosensitive layer to obtain the recorded latent image; and (c) forming a protective layer on the photosensitive layer, said protective layer including a layer of a glassy, optically transparent, polar, moisture barrier material about 0.2 to 10 μm thick.

12. The process of claim 11 in which said protective layer comprises an optically transparent cover material coated with a layer of the moisture barrier material, attached to the photosensitive layer through the moisture barrier layer.

13. A process for fabricating a hologram which comprises:

(a) forming a layer of a glassy, optically transparent, polar, moisture barrier material about 0.2 to 10 μm thick on an optically transparent hydrophobic substrate by a process which generates a temperature at the substrate of less than that of its softening point at which it deforms;

(b) forming a layer of a hydrophilic, photosensitive material on at least a portion of the moisture barrier layer, the moisture barrier layer providing a barrier against diffusion of water vapor from the hydrophobic substrate into the hydrophilic, photosensitive layer such that over the lifetime of the hologram, no more than about $2\times10^{-6}$ g $H_2O/cm^2$ is transmitted therethrough;

(c) exposing the photosensitive layer to an actinic interference pattern to record a latent image thereon;

(d) developing the photosensitive layer to obtain the recorded latent image; and (e) forming a protective layer on the photosensitive layer, said protective layer including a layer of a glassy, optically transparent, polar, moisture barrier material about 0.2 to 10 μm thick.

14. The process of claim 13 in which the hydrophobic substrate includes a plastic material selected from the group consisting of cellulose-acetate, polystyrene, polyester, poly-(methyl methacrylate) and polycarbonate.

15. The process of claim 14 in which the plastic material is selected from the group consisting of poly-(methyl methacrylate) and polycarbonate.

16. The process of claim 13 in which the moisture barrier layer comprises a glass having a high coefficient of expansion.

17. The process of claim 16 in which the moisture barrier material comprises a glass selected from the group consisting of silicate, borosilicate, alkali silicate, soda-lime and lead glasses.

18. The process of claim 17 in which the moisture barrier layer consists essentially of glassy $SiO_2$.

19. The process of claim 13 in which the thickness ranges from about 0.2 to 1 μm.

20. The process of claim 13 in which the moisture barrier layer is deposited by electron beam evaporation or plasma-enhanced deposition.

21. The process of claim 13 in which the photosensitive material is gelatin-based.

22. The process of claim 21 in which the photosensitive material comprises an emulsion selected from the group consisting of dichromated gelatin, photographic silver halide emulsion and diazo gelatin.

23. The process of claim 13 in which the protective layer comprises an optically transparent cover material coated with a layer of the moisture barrier material, attached to the photosensitive layer through the moisture barrier layer.

* * * * *